US009166266B1

(12) United States Patent
Liu

(10) Patent No.: US 9,166,266 B1
(45) Date of Patent: Oct. 20, 2015

(54) COMPACT STRIPLINE AND AIR-CAVITY BASED RADIO FREQUENCY FILTER

(75) Inventor: Yin Liu, Fremont, CA (US)

(73) Assignee: SuZhou Luowan Electronic Technology Ltd. Co., Suzhou (CN)

( * ) Notice: Subject to any disclaimer, the term of this patent is extended or adjusted under 35 U.S.C. 154(b) by 771 days.

(21) Appl. No.: 13/339,352

(22) Filed: Dec. 28, 2011

Related U.S. Application Data

(60) Provisional application No. 61/428,189, filed on Dec. 29, 2010.

(51) Int. Cl.

| | |
|---|---|
| ***H01P 5/12*** | (2006.01) |
| ***H01P 1/213*** | (2006.01) |
| ***H01P 1/207*** | (2006.01) |
| ***H01P 1/202*** | (2006.01) |

(52) U.S. Cl.
CPC ..... *H01P 1/2136* (2013.01); *H01P 1/202* (2013.01); *H01P 1/207* (2013.01)

(58) Field of Classification Search
CPC ... H01P 1/2056; H01P 1/2135; H01P 1/2136; H01P 1/20381; H01P 1/202
USPC ..... 333/134, 204, 206
See application file for complete search history.

(56) References Cited

U.S. PATENT DOCUMENTS 2,491,681 A * 12/1949 Minter ..... 333/168
4,521,755 A * 6/1985 Carlson et al. ..... 333/244

* cited by examiner

*Primary Examiner* — Robert Pascal
*Assistant Examiner* — Kimberly Glenn
(74) *Attorney, Agent, or Firm* — Zheng Jin

(57) ABSTRACT

A method is proposed for designing compact stripline and air-cavity based (SACB) RF filters, duplexers, and multiplexers. The target frequency band is 600 MHz~3 GHz. The proposed devices feature both compact size (with 50% size reduction compared to traditional resonator air cavity design) and high power handling capability as well as low insertion-loss. In the SACB filter, striplines and cavities are used to emulate LC resonator (quasi-LC resonator). The combination of striplines and cavities forms a structure that exhibit the performance of an electric resonator circuit of inductor and capacitor (LC). The outside signal will be connected to the striplines, and the ground will be connected to the metal shield which forms the cavity. By controlling the dimensions of the stripline width and length as well as the size of the cavity, the desired filter response is achieved.

15 Claims, 6 Drawing Sheets

TOP VIEW OF SINGLE LAYER STRUCTURE

RF DUPLEXER STRUCTURE

RF DUPLEXER FREQUENCY SPECIFICATION

TOP VIEW OF SINGLE LAYER STRUCTURE

3D VIEW OF SINGLE LAYER STRUCTURE

SIDE VIEW OF MULTI LAYER STRUCTURE

3D VIEW OF MULTI LAYER STRUCTURE

DUPLEXER SYNTHESIS PROCESS

COMPACT STRIPLINE AND AIR-CAVITY BASED RADIO FREQUENCY FILTER

CROSS REFERENCE TO RELATED APPLICATION

This application claims priority under 35 U.S.C. §119 from U.S. Provisional Application No. 61/428,189, entitled "Compact Air-Cavity Based Filters/Duplexers/Multiplexers" filed on Dec. 29, 2010, the subject matter of which is incorporated herein by reference.

TECHNICAL FIELD

The present invention relates generally to radio wave frequency filtering technology, more particularly, to method of implementing radio frequency filters, duplexers and multiplexers using striplines and cavities.

BACKGROUND

A radio frequency (RF) filter is a device that is utilized to allow or stop selected RF signals in a specific range of frequencies, or used to eliminate/filter out any unwanted RF signals. That is, an RF filter is designed to allow for attenuation or transmission of a range of frequencies that would be applied. For example, an RF filter in a wireless device is used to receive designated RF signals and also helps to cut RF interference that could occur if a hairdryer, lamp, or other "noisy" device is activated. Four general filter functions are desirable: a band-pass filter that selects only a desired band of frequencies, a band-stop filter that eliminates an undesired band of frequencies, a low-pass filter that allows only frequencies below a cutoff frequency to pass, and a high-pass filter that allows only frequencies above a cutoff frequency to pass.

Radio frequency (RF) and microwave filters usually are designed to operate on signals in the megahertz (MHz) to gigahertz frequency (GHz) ranges (medium frequency to extremely high frequency). This frequency range is the range used by most broadcast radio, television, wireless communication (cell phones, Wi-Fi, etc. . . . ), and thus most RF and microwave devices will include some kind of filtering on the signals transmitted or received. Such filters are commonly used as building blocks for duplexers to combine or separate multiple frequency bands. In general, RF and microwave filters are most commonly made up of one or more coupled resonators, and thus any technology that can be used to make resonators can also be used to make filters.

Currently, radio frequency (RF) filters for receiving and transmitting radio waves in the selected frequency band utilizes several known technologies. For example, coaxial filter uses coaxial transmission lines providing higher quality factor than planar transmission lines, and is thus used when higher performance is required. The coaxial resonators may make use of high-dielectric constant materials to reduce their overall size. However, the dimension of a resonator filter is constrained by the pass band frequency and its physical size cannot be reduced as desired.

The most commonly used high power radio frequency (RF) filter is cavity filter. Cavity filter (e.g. waveguide filter) offers high quality factor (Q factor), which indicates a lower rate of energy loss. Well constructed cavity filters are capable of high selectivity even under power loads of at least a megawatt. Higher Q quality factor, as well as increased performance stability at closely spaced (down to 75 kHz) frequencies, can be achieved by increasing the internal volume of the filter cavities. Physical length of conventional cavity filters can vary from over 82" in the 40 MHz range, down to under 11" in the 900 MHz range. In the microwave range (1000 MHz (or 1 GHz) and higher), cavity filters become more practical in terms of size and a significantly higher quality factor than lumped element resonators and filters, though power handling capability may diminish. Similar to coaxial resonator filter, however, the dimension of a cavity filter is also determined by the pass band frequency. Therefore, its physical size cannot be reduced.

Pucks made of various dielectric materials can be used as an alternative to make resonators for dielectric filters. As with the coaxial resonators, high-dielectric constant materials may be used to reduce the overall size of the filter. With low-loss dielectric materials, these can offer significantly higher performance than the other technologies previously discussed. Electro-acoustic resonators based on piezoelectric materials can be used for filters. Since acoustic wavelength at a given frequency is several orders of magnitude shorter than the electrical wavelength, electro-acoustic resonators are generally smaller than electromagnetic counterparts such as cavity resonators. A common example of an electro-acoustic resonator is the quartz resonator which essentially is a cut of a piezoelectric quartz crystal clamped by a pair of electrodes. This technology is limited to some tens of megahertz. For microwave frequencies, thin film technologies such as surface acoustic wave (SAW) and, bulk acoustic wave (BAW) have been used for filters. Although dielectric resonator filter offers superior properties, the production of dielectric resonator filters depends on rare earth materials. Thus the cost is high, and dimensions are still too big.

An LC circuit, also called a resonant circuit or tuned circuit, consists of an inductor, represented by the letter L, and a capacitor, represented by the letter C. When connected together, they can act as an electrical resonator, an electrical analogue of a tuning fork, storing electrical energy oscillating at the circuit's resonant frequency. In a LC circuit, the pass band frequency is determined by the resonant frequency. The relation between resonant frequency ($f_0$ in Hertz) and the values of LC and C is described as $$f_0 = \frac{1}{2\pi\sqrt{LC}}.$$

LC circuit is a classical RF filter. However, due to current limitations of the L and the C devices, it cannot be used in high quality factor and high power handling applications such as base stations.

Striplines, which is supported by dielectric substrate on both sides, have also been used in RF filter applications. However, such filter cannot handle high RF power. Furthermore, the quality factor (Q value) of this type of filter is limited due to the additional substrate loss.

SUMMARY

In the present invention, a new design method is used for designing compact stripline and air-cavity based (SACB) RF filters, duplexers, and multiplexers for wireless base stations, cell phones and other RF signal process applications. The target frequency band is 600 MHz~3 GHz. The developed devices feature both compact size (with 50% size reduction as compared to tradition resonator air cavity design) and high power handling capability as well as low insertion-loss.

According to one embodiment, the present invention is directed to a compact stripline and air-cavity based (SACB) filter which combines metal-made-striplines and metal-formed-cavities. The dimensions of a metal-made-stripline are determined by the quasi-wave length of the pass band frequency. The metal-formed-cavity determines the quality factor (Q value) of the filter. In such filter, a stripline is surrounded by an air cavity. In one novel aspect, stripline in air cavity with quasi-lumped response is employed to construct the RF filter to achieve substantial performance improvement in terms of insert-loss and reducing filter size. Compact air-cavity based filters consist of Quasi-lumped components. The proposed filters will be constructed using striplines in air or vacuum-filled cavities. The quasi-lumped component is the fusion of lumped component and distributive component. It is realized by transmission line structures (distributive), exhibiting lumped component properties.

According to another embodiment, the present invention is directed to a RF duplexer. The RF duplexer is formed by two compact stripline and air-cavity based (SACB) filters. One set of striplines and cavities of SACB filters is arranged to pass energy in a received radio (RX) mode, and the other set of striplines and cavities of SACB filters is arranged to pass energy in a radio-transmit (TX) mode. Compact stripline and air-cavity based duplexers consist of compact RX and TX filters. Each filter is based on the compact SABC filter structure. The compact SABC duplexer is a three-port network, where the receiving and transmitting channels construct the two output ports. The input port is connected to the incoming signal port (e.g. antenna port).

In yet another embodiment, the present invention is directed to a RF multiplexer. The RF multiplexer is formed by four SACB filters. Two of the four sets of striplines and cavities of SACB filters are arranged to pass energy in a receive radio (RX) mode for two different radio frequency waves, and the other two of the four sets of striplines and cavities of SACB filters are arranged to pass energy in a radio-transmit (TX) mode for two different radio frequency waves.

According to one more embodiments, a novel synthesis method for SACB filter design is proposed. In traditional methods, the RX and TX filters are synthesized as independent filters and they are combined by the junction to form the duplexer. However, after the combination, post-tunings are needed to achieve the desired performance. In one novel aspect of present invention, special synthesis method considering the effect of junctions in the duplexers and multiplexers are applied during the synthesis process. The method is based on the polynomials of entire network and uses Genetic Algorithm and Cauchy's method. This design approach eliminates the post-tuning process in the conventional duplexer and multiplexer design methods. As a result, the synthesized filter features small dimension for great size reduction.

While the invention can be used for various modifications and alternative forms, specific embodiments shown are only examples in the drawings and will herein be described in detail. It should be understood, however, that such description is not intended to limit the invention to the particular forms disclosed. On the contrary, the intention is to cover all modifications, equivalents, and alternatives falling within the spirit and scope of the invention as defined by the appended claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings. Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

Figure 1:
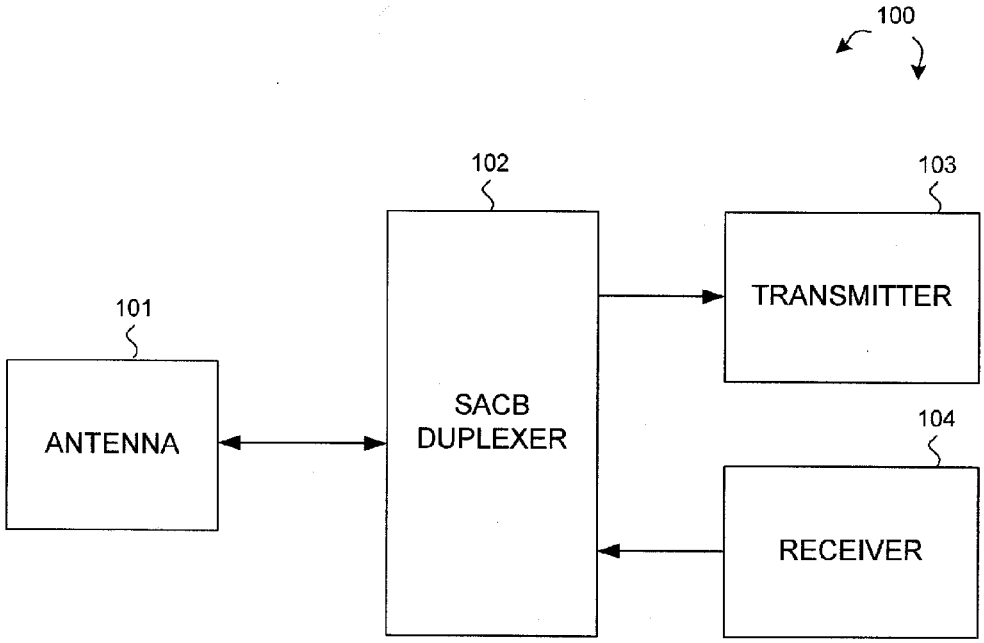
FIG. 1 shows a receive/transmit network containing a SACB duplexer.

Modern telecommunications systems, such as cell phones and base stations, often require full duplex capability that allows simultaneous data transmission and reception. FIG. 1 illustrates a radio frequency (RF) transmitting and receiving network 100 that contains a stripline and air-cavity based (SACB) RF duplexer 102 in accordance with one novel aspect. RF network 100 employs a common antenna 101 for use with transmitter unit 103 and a receiver unit 104, and SACB RF duplexer 102 interlinks the transmitter unit 103, the receiver unit 104, and the common antenna 101. SACB RF Duplexer 102 is a device with the objective of isolating transmitter 103 from receiver 104. This will then allow transmitter 103 and receiver 104 to operate on the same antenna 101 at the same time without transmitter 103 adversely affecting receiver 104 and vice versa.

Figure 2:
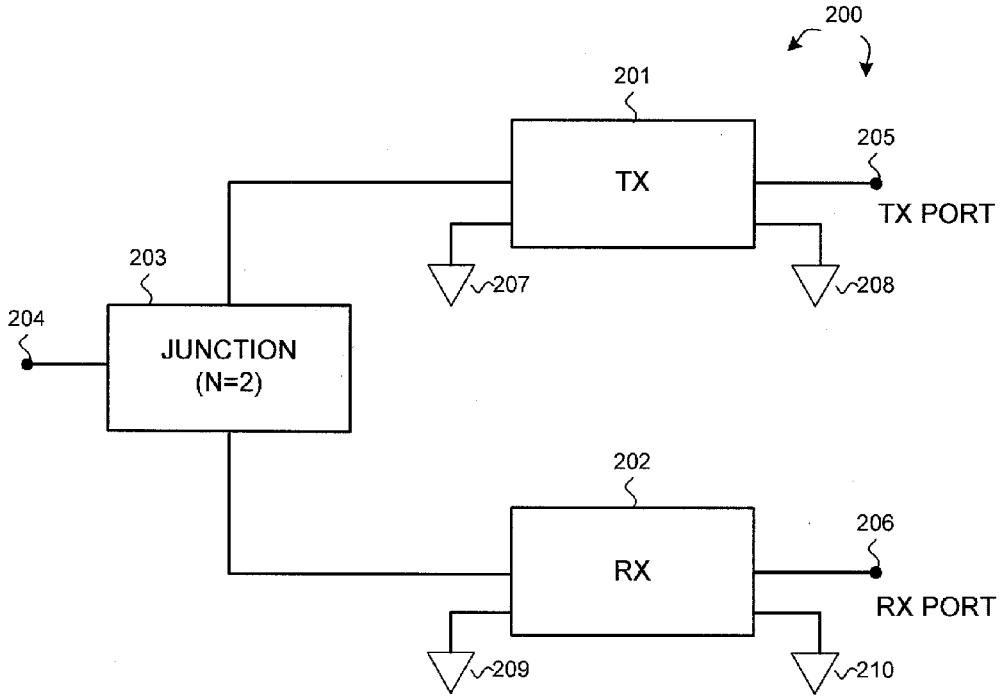
FIG. 2 is an illustration of a structure of a RF duplexer. The duplexer is formed by two sets of components. One is arranged to pass energy in a receive radio (RX) mode, and the other is arranged to pass energy in a radio-transmit (TX) mode.

FIG. 2 is a simplified block diagram of the structure of a RF duplexer 200 in accordance with one novel aspect. Duplexer 200 is formed by two compact stripline and air-cavity based (SACB) filters 201 and 202. SACB filter 201 passes energy in a radio-transmit (TX) mode, and SACB filter 202 passes energy in a received radio (RX) mode. For transmitting, source signal from TX port 205 is passed through to transmitting filter 201 and junction 203. Then the signal is transmitted out by an antenna that is connected to port 204. On the receiving direction, radio signal received by the antenna connected to port 204 passes through the junction point 203. Then the signal reaches RX port 206 via receiving filter 202. In FIG. 2, triangle symbols 207, 208, 209 and 210 annotate the ground connection points.

Figure 3:
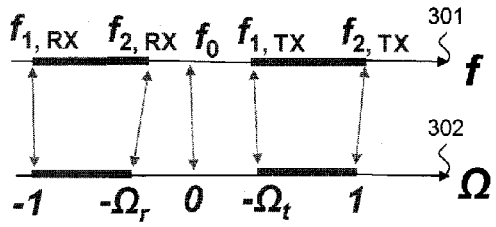
FIG. 3 is an illustration of a communications system specification incorporating a duplexer according to one embodiment of the present invention.

FIG. 3 is an illustration of a RF communication system specification incorporating a duplexer according to one embodiment of the present invention. The requirement of a passband filter is specified by its lower and upper cutoff frequencies. FIG. 3 shows a duplexer filter specification in both frequency axial (f) 301 and normalized frequency axial (Ω) 302. On frequency axial 301, $f_{1,RX}$ and $f_{2,RX}$ are correspond to the lower and upper passband cutoff frequencies of receiving band respectively, and $f_{1,TX}$ and $f_{2,TX}$ refer to the lower and upper cut-off frequency of the transmission band. In filter design, a given design can be used at different sample-rates, resulting in different frequency responses. Normalization produces a distribution that is independent of the sample rate, and thus one plot is sufficient for all possible sample rates. Therefore, in order to achieve the desired performance, the duplexer is first analyzed (synthesized) by normalizing the frequency range. The normalized frequency (Ω) is defined as $$\Omega=(f_0/B)(f/f_0-f_0/f)$$

where $f_0$ corresponds to the center frequency, B corresponds to the bandwidth, and f corresponds to the general frequency. As shown on the normalized frequency axial (Ω) 302, normalized frequencies −1 and $-\Omega_r$ correspond to the lower and upper passband cutoff frequencies of receiving band respectively, and normalized frequencies $-\Omega_t$ and 1 correspond to the lower and upper passband cutoff frequencies of transmission band respectively.

Figure 4A:
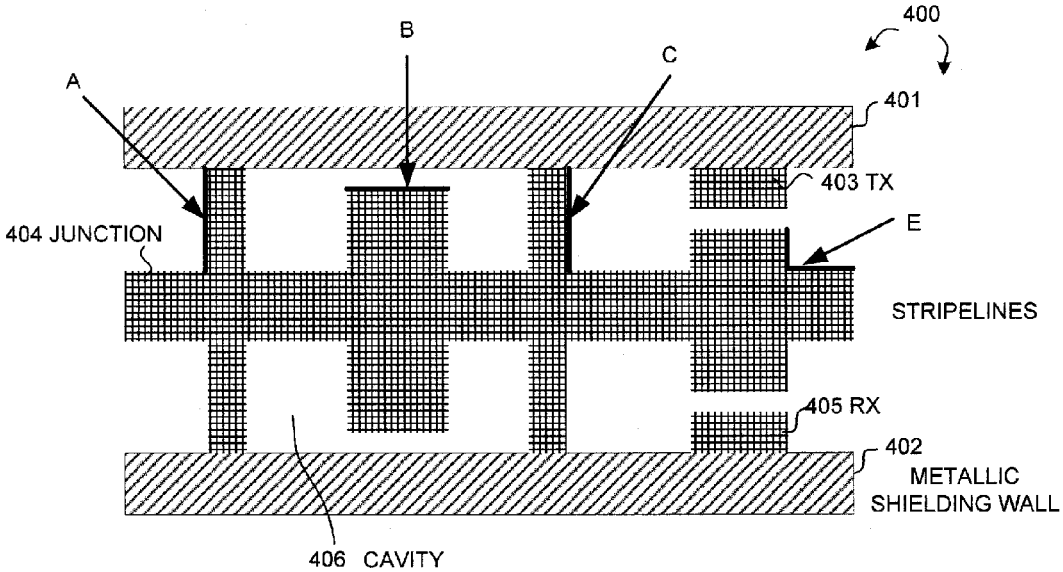
FIG. 4A is an illustration of a top view of a single layer duplexer according to an embodiment of the present invention.

FIG. 4A illustrates a top view of a proposed duplexer 400 with a single-layer structure, where different geometrical shaped striplines shaded with small grids are the key enabling components of duplexer 400. Components 403, 405 and 404 are TX port, RX port and junction point of the duplexer respectively. Italic line-shaded blocks 401 and 402 are metallic shielding wall. In a SACB filter, a stripline is within an air cavity formed by the metal walls, i.e. the air cavity houses the stripline. Since the stripline is made of thick metal which is a good thermal conductor, the filter can withstand large input/output power, and can work in relatively wide temperature range. Because the filters are all made of metal, the need of using expensive dielectric substrates is eliminated and therefore, overall manufacturing cost is greatly reduced. Also, because the designed filter is consisted entirely of metals, it has a good heat dissipation and power-handling capacity.

In a SACB filter, stripline and cavity are used to emulate LC resonator (quasi-LC resonator). Small physical size of the filter can exhibit the properties of a larger physical size of the microwave filter, while taking advantage of the synthesis of LC combined effect of the cavity to obtain high-Q filtering performance. The combination of stripline and cavity forms a structure that exhibit the performance of an electric resonator circuit of inductor and capacitor (LC). The outside signal will be connected to the stripline, and ground will be connected to the metal shell which forms the cavity. By controlling the dimensions of the stripline width and length as well as the size of the cavity, the desired filter response can be achieved. Specifically, the stripline section without touching the sidewall will be used to realize quasi-lumped capacitors, and stripline section touching the sidewall will be used to realize quasi-lumped inductors. In FIG. 4A, examples of sections do not touch the sidewall include stripline sections B and E, while sections touches the sidewall include sections A and C. In order to obtain a desired filter performance such as bandwidth and Q value, a series of striplines, blocks 403, 404 and 405, and cavities (e.g., cavity 406) representing multi-order resonators are used in the SACB filter.

Figure 4B:
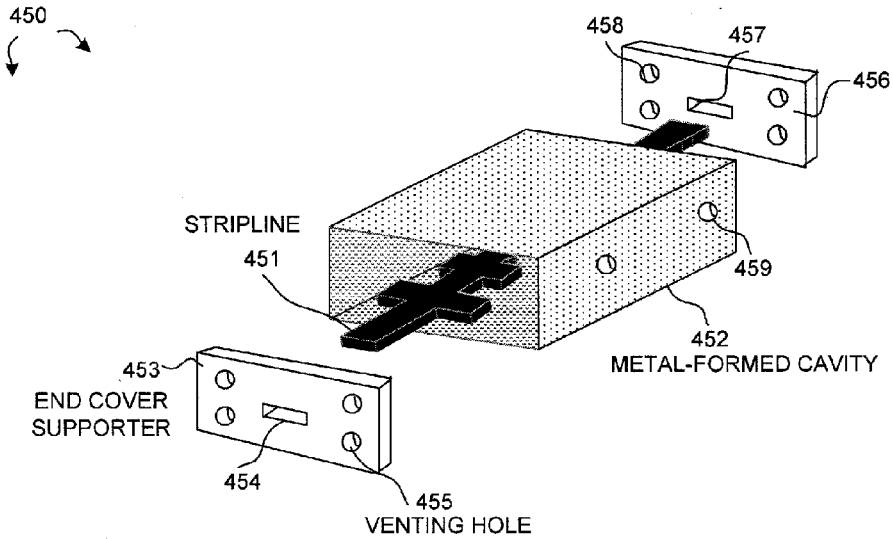
FIG. 4B is an illustration of a 3D view of a single layer SACB filter according to an embodiment of the present invention.

FIG. 4B illustrates a 3D view of a proposed SACB filter 450 with a single-layer structure. SACB filter 450 consists of metal-formed cavity 452 as the container of stripline 451 and two flat end covers 453 and 456. Stripline 451 is fixed in position by connecting to the holes on end covers 453 and 456 as supporters. Stripline 451 is supported at one end by inserting and connecting to hole 454 on end cover/supporter 453 and supported at the other end by inserting and connecting to hole 457 on end cover/supporter 456. Metal formed cavity 452 may have small holes (e.g., venting hole 459) for better hot air venting purpose. Similarly, the two end covers may also have venting holes (e.g., venting holes 455 and 458). Venting holes are optional and they should be small enough to avoid RF leaking.

Figure 5A:
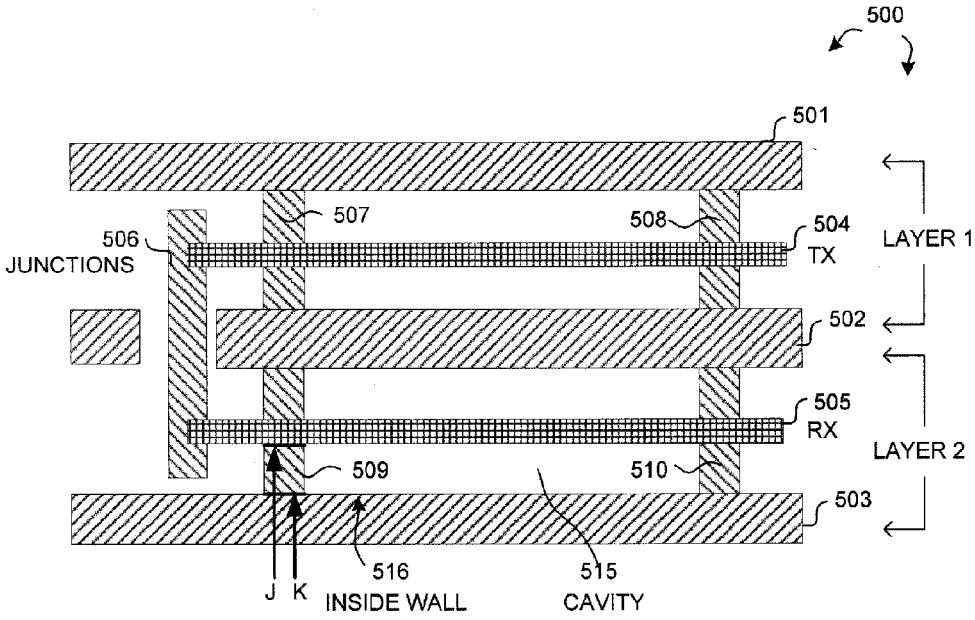
FIG. 5A is an illustration of a side view of a multi layer duplexer according to an embodiment of the present invention.

Reference will now be made to FIG. 5A. To further reduce the total size of a duplexer, multi-layer structure can be considered. In FIG. 5A, a side view of a duplexer 500 having a two-layer structure is illustrated. Metallic wall 502 is inserted between metallic shielding wall 501 and 503 to form two layers, layer 1 and layer 2. In layer 1, stripline 504 is placed as a RF filter in transmitting direction while in layer 2, stripline 505 is placed as a RF filter in receiving direction. Note that striplines 504 and 505 are placed in the cavities formed by the metallic walls. For example, stripline 505 is located inside air cavity 515 between metallic wall 502 and 503. Junction 506 is used as inter-coupling connector between layer 1 and layer 2. With junction 506, TX striplines and RX striplines are connected to form a short circuit.

As a stripline is placed inside of an air cavity formed by metal walls, it needs to be supported so its position can be fixed. In FIG. 5A, stripline 504 is supported by attaching one end to supporter 507 and the other end to supporter 508 while stripline 505 is supported by supporters 509 and 510 similarly. For example, supporter 513 has one end K pivotally connected to the inside wall 516 of metallic wall 503, and the other end J pivotally connected to the stripline 505. More supporters may be needed as the length of a stripline gets longer to better support the stripline. For example, a first supporter is connected to one end of the stripline, a second supporter is connected to another end of the stripline, and a third supporter is connected to an approximate center of the stripline. The supporters may be made of metal or dielectric material.

Figure 5B:
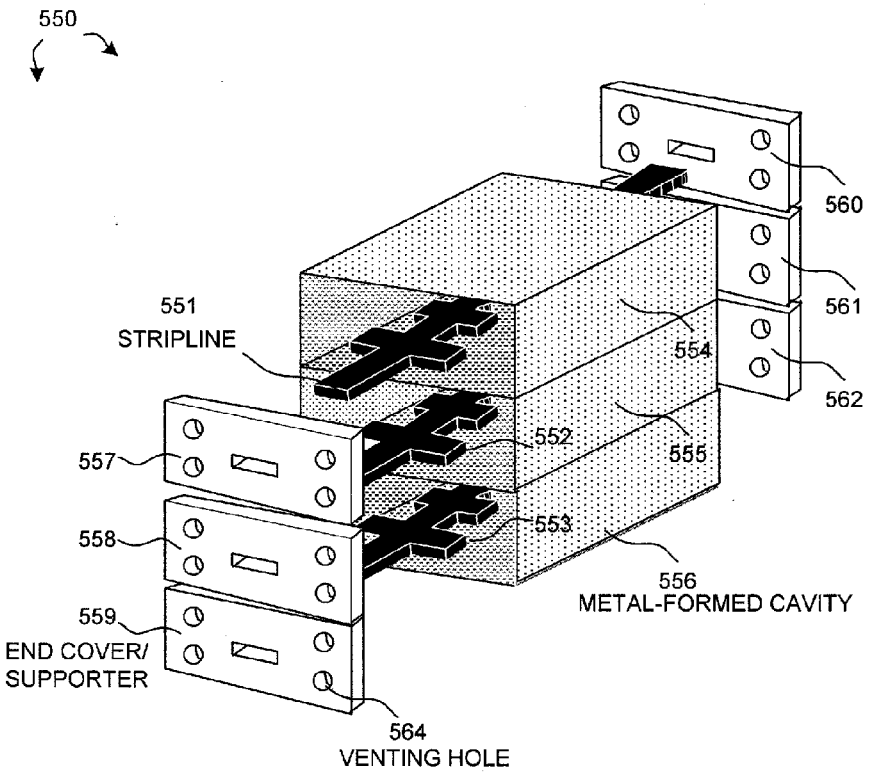
FIG. 5B is an illustration of a 3D view of a multi layer SACB multiplexer according to an embodiment of the present invention.

FIG. 5B illustrates a 3D view of a proposed SACB multiplexer 550 with a multi-layer structure. SACB multiplexer 550 consists of striplines 551, 552 and 553, metal-formed cavities 554, 555 and 556 and end covers/supporters 557, 558, 559, 560, 561 and 562. Cavities 554, 555 and 556 houses striplines 551, 552 and 553 respectively. The striplines are fixed in position by the supporters. For example, Stripline 553 is supported at both ends by supporters 562 and 559. Metal formed cavities may have small holes for better hot air venting purpose. Similarly, venting holes can be cut on the two end covers (e.g., venting hole 564). Venting holes are optional and they should be small enough to avoid RF leaking.

Figure 6:
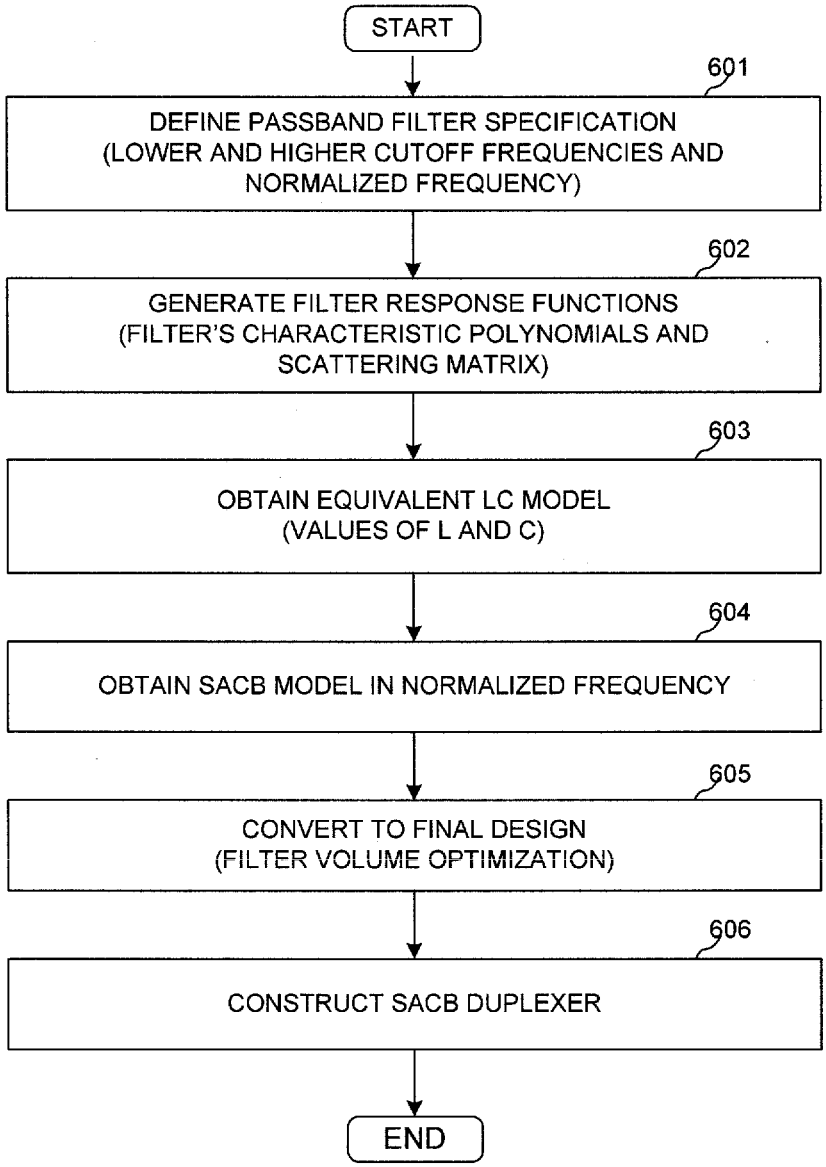
FIG. 6 is a flow diagram for synthesis of SACB filters.

FIG. 6 is a flow diagram for describing the design process for a RF duplexer. In order to reduce interference between multiple pass bands while reducing the volume of the filter, a new analytical method is used. The designed filter will exhibit the performance of an elliptic filter. As shown at block 601 in FIG. 6, the first step of design a duplexer filter is to define its specification by specifying passband and stopband requirement. Duplexer specification includes lower and upper cutoff frequencies for RX mode and the lower and upper cutoff frequencies for transmit mode. The duplexer is then analyzed (synthesized) by normalizing the frequency range. The normalized frequency (Ω) is defined as $\Omega=(f_0/B)\ (f/f_0-f_0/f)$, where $f_0$ corresponds to the center frequency, B corresponds to the bandwidth, and f corresponds to the general frequency. At block 602, the mathematical formulation of a filter response function is generated. The filter response function, in the form of characteristic polynomials, 'approximates' the ideal filter function for a given set of filter specifications.

S-parameters describe the response of an N-port network to voltage signals at each port. The first number in the subscript refers to the responding port, while the second number refers to the incident port. Thus $S_{21}$ means the response at port 2 due to a signal at port 1. In a duplexer, each of the RX and TX filters are a two port network. For the RX filter, the input is the antenna and output is the RX port. Similarly, for the TX filter, the input is TX port and the antenna is the output. The scattering matrices (S-parameters) of the RX and TX filters in the duplexer are further expressed as:

$$S_{11}^{TX}=F_{TX}(s)/E_{TX}(s)$$

$$S_{21}^{TX}=P_{TX}(s)/E_{TX}(s)=p_{TX}P_{TXn}(s)/E_{TX}(s)$$

$$S_{11}^{RX}=F_{RX}(s)/E_{RX}(s)$$

$$S_{21}^{RX}=P_{RX}(s)/E_{RX}(s)=p_{RX}P_{RXn}(s)/E_{RX}(s)$$

where, S corresponds to the S-parameters. F(s), E(s), and P(s) correspond to the characteristic polynomials constructing the whole filter function. Cauchy method has proved to be an effective technique for extracting the characteristic polynomials F, P and E of a filter from the measured S-parameter. Through the above expression, combined with the characteristic polynomial of the connection point (junction), the performance of the designed SACB duplexer can be completely characterized by the corresponding characteristic polynomial. In order to achieve a good pass-band rejection, multiple transmission zeros, frequencies where signal transmission between input and output is stopped, are included in the final prototype of the duplexer.

At step 603, based on the final design of the characteristic polynomial, the LC model of the appropriate duplexer can be determined. The values of inductance L and capacitance C are determined at this step. In order to reduce the overall volume of the duplexer, the values of the corresponding L and C in the LC model should be as small as possible.

At step 604, the LC model is converted to SACB mode by applying Richards Transformation which allows open and short circuit transmission line segment to emulate the inductive and capacitive behavior of lumped components. At Step 605, when the equivalent circuit of the SACB duplexer in the normalized frequency range is obtained, Richards Transformation is used to complete the conversion of the frequency from the normalized frequency to that of the final design. In this process, the volume of the filter can be further reduced by changing the center frequency of choice. Design parameters including dimensions of the stripline width and length as well as the size of the cavity are determined at this step.

In the SACB filter, stripline and cavity are used to emulate LC resonator (quasi-LC resonator). The quasi-LC components are used to realize compact RF filters with low loss. High Q value is obtained by employing a cavity with proper size. In one novel aspect of the present invention, the synthesis of the filter, duplexer, and multiplexer is based on Cauchy's method and genetic algorithm to get the optimized design parameters. A genetic algorithm (GA) is a search heuristic that mimics the process of natural evolution. Cauchy method is a well known technique for generating a reduced-order rational polynomial model from measurements or simulations of microwave passive devices including RF filters. This heuristic is routinely used to generate useful solutions to optimization and search problems. Specifically, for the duplexer design, a special procedure is applied based on the evaluation of the characteristic polynomials of the duplexer. The characteristic polynomials include the three-port junction connecting the TX (transmitting channel) and RX (receiving channel) filters. Here, the three-port junction suitable for stripline and air cavity based filter implementation is considered (junctions for waveguide and coaxial-line can also be considered). This innovative method allows the synthesis of the two composing filters (e.g. RX and TX filters) independently. It also takes into account the effect of the duplexer's junction to the whole device. Based on the same procedure, multiplexers can also be synthesized.

The synthesized filter/duplexer/multiplexer components are transformed to the desired design frequency using frequency transformation technique to achieve proper component values with size reductions. Cauchy's method and genetic algorithm is applied again to optimize these design parameters. At step 606, once the whole design process is finished, the proposed filters, duplexers, and multiplexers are constructed using the striplines.

What is claimed is:

1. A radio frequency (RF) filter, comprising:

a metal-made stripline, wherein dimensions of the stripline determine a passband frequency and a bandwidth of the RF filter;

a metal-wall-formed cavity housing the stripline for providing a quality factor (Q value) of the RF filter; and a plurality of supporters, each supporter is attached to the metal-wall-formed cavity to fix the position of the stripline by connecting to the stripline, wherein a first supporter is connected to one end of the stripline, wherein a second supporter is connected to another end of the stripline, and wherein a third supporter is connected to an approximate center of the stripline.

2. The filter of claim 1, wherein the supporters are made of metal or dielectric material.

3. The filter of claim 1, wherein the metal-wall-formed cavity is filled with air.

4. The filter of claim 1, wherein the metal-wall-formed cavity is vacuumed.

5. The filter of claim 1, wherein the filter comprises Quasi-lumped components, and wherein the Quasi-lumped component is the fusion of lumped component and distributive component.

6. An apparatus, comprising:

a first compact stripline and air-cavity based (SACB) filter having a first port, and a second compact SACB filter having a second port, each SACB filter comprises:

a metal-made stripline, wherein dimensions of the stripline determine a passband frequency and a bandwidth of the SACB filter;

a metal-wall-formed cavity housing the stripline for providing a quality factor (Q value) of the SACB filter; and a plurality of supporters, each supporter is attached to the metal-wall-formed cavity to fix the position of the stripline by connecting to the stripline; and a metal connector connecting a first stripline of the first filter and a second stripline of the second filter to form a three-port junction.

7. The apparatus of claim 6, wherein the apparatus is constructed with a single-layer structure formed by a first metallic shielding wall and a second metallic shielding wall, and wherein the first SACB filter and the second SACB filter are located between the first wall and second wall.

8. The apparatus of claim 6, wherein the apparatus is constructed with a double-layer structure formed by a first metallic shielding wall, a second metallic shielding wall, and a third metallic shielding wall, wherein the first compact SACB filter is located between the first wall and the second wall, and wherein the second compact SACB filter is located between the second wall and third wall.

9. The apparatus of claim 6, wherein the apparatus is a duplexer, wherein the first SACB filter receives radio signals with a first radio frequency wave, and wherein the second SACB filter transmits radio signals with a second radio frequency wave.

10. The apparatus of claim 6, wherein the apparatus is a multiplexer, wherein the multiplexer further comprises a third and a fourth compact SACB filters, wherein the first and the third filters receive radio signals with two different radio frequency waves, and wherein the second and the fourth SACB filters transmit radio signals with two different radio frequency waves.

11. The apparatus of claim 6, wherein the supports are made of metal or dielectric material.

12. The apparatus of claim 6, wherein the metal-wall-formed cavity is filled with air.

13. The apparatus of claim 6, wherein the metal-wall-formed cavity is vacuumed.

14. The apparatus of claim 6, wherein each SACB filter comprises Quasi-lumped components, and wherein the Quasi-lumped component is the fusion of lumped component and distributive component.

15. A radio frequency (RF) filter, comprising:

a metal-made stripline, wherein dimensions of the stripline determine a passband frequency and a bandwidth of the RF filter;

a metal-wall-formed cavity housing the stripline for providing a quality factor (Q value) of the RF filter, wherein the metal-wall-formed cavity is vacuumed; and a plurality of supporters, each supporter is attached to the metal-wall-formed cavity to fix the position of the stripline by connecting to the stripline.

* * * * *